US009004087B2

(12) United States Patent
Ma

(10) Patent No.: US 9,004,087 B2
(45) Date of Patent: Apr. 14, 2015

(54) CONTROLLABLE AUTOMATIC UMBRELLA UNFOLDING DEVICE

(76) Inventor: Zhunan Ma, Ningbo (CN)

( * ) Notice: Subject to any disclaimer, the term of this patent is extended or adjusted under 35 U.S.C. 154(b) by 0 days.

(21) Appl. No.: 14/111,355

(22) PCT Filed: Dec. 5, 2011

(86) PCT No.: PCT/CN2011/083456

§ 371 (c)(1),
(2), (4) Date: Dec. 23, 2013

(87) PCT Pub. No.: WO2012/139395

PCT Pub. Date: Oct. 18, 2012

(65) Prior Publication Data

US 2014/0116481 A1 May 1, 2014

(30) Foreign Application Priority Data

Apr. 12, 2011 (CN) ..... 2011 2 0104025 U

(51) Int. Cl.
*A45B 25/16* (2006.01)
*A45B 25/14* (2006.01)

(52) U.S. Cl.
CPC ..... *A45B 25/165* (2013.01); *A45B 25/143* (2013.01)

(58) Field of Classification Search
CPC ..... A45B 25/16
USPC ..... 135/20.3, 22
See application file for complete search history.

(56) References Cited

U.S. PATENT DOCUMENTS

| | | | | | |
|---|---|---|---|---|---|
| 1,088,743 | A * | 3/1914 | Swinland | 135/26 |
| 3,213,868 | A * | 10/1965 | Forbes | 135/98 |
| 3,455,312 | A * | 7/1969 | Vogel | 135/23 |
| 3,706,160 | A * | 12/1972 | Deibert | 47/23.2 |
| 4,011,881 | A * | 3/1977 | Becher | 135/20.3 |
| 4,523,601 | A * | 6/1985 | Grady et al. | 135/22 |
| 4,747,422 | A * | 5/1988 | Chung | 135/20.2 |
| 4,807,655 | A * | 2/1989 | Robertson | 135/22 |
| 5,655,557 | A * | 8/1997 | Martin | 135/15.1 |
| 6,202,660 | B1 * | 3/2001 | Steiner | 135/22 |
| 2005/0045217 | A1 * | 3/2005 | Clarke | 135/20.3 |

FOREIGN PATENT DOCUMENTS

| | | | |
|---|---|---|---|
| CN | 2123910 | U | 12/1992 |
| CN | 2377894 | Y | 5/2000 |
| CN | 2617214 | Y | 5/2004 |
| WO | WO2010024786 | A | 3/2010 |

* cited by examiner

*Primary Examiner* — Noah Chandler Hawk
(74) *Attorney, Agent, or Firm* — Jacobson Holman PLLC; Jiwen Chen

(57) ABSTRACT

A controllable automatic umbrella unfolding device includes an upper runner, a middle runner, a lower runner and a center bar. The upper runner is fixed at the top end of the center bar, the middle runner and the lower runner of the umbrella are movably sleeved on the center bar, the upper runner is connected with long ribs, the long ribs are connected with short ribs, the middle runner is connected with branch ribs, the branch ribs are connected with the short ribs, the short ribs are connected with the lower runner, a gas spring is disposed in the center bar, the tail end of a cylinder barrel of the gas spring is connected with the middle runner of the umbrella, a valve is arranged at the end of a piston rod of the gas spring, and a valve opening device is disposed corresponding to the valve.

3 Claims, 5 Drawing Sheets

CONTROLLABLE AUTOMATIC UMBRELLA UNFOLDING DEVICE

This is a U.S. national stage application of PCT Application No. PCT/CN2011/083456 under 35 U.S.C. 371, filed Dec. 5, 2011 in Chinese, claiming the priority benefit of Chinese Application No. 201120104025.8, filed Apr. 12, 2011, which is hereby incorporated by reference.

TECHNICAL FIELD

The present invention relates to the field of parts of a sunshade umbrella, in particular to a controllable automatic umbrella unfolding device.

BACKGROUND

A traditional sunshade umbrella is opened in such a manner of: driving the umbrella rope and the pull lever through an umbrella unfolding crank, and then pushing by hand; such a crank-opening way has the defects of troublesome umbrella unfolding, slow opening speed and high breakage possibility of the umbrella rope; there is another pull lever-type opening and closing device, which, however, is high in umbrella position after pull lever-type closing and also quite inconvenient. In the early Chinese patent of the applicant: Umbrella unfolding and Closing Device (Patent Number: ZL200420107976.0) and the subsequent improved Chinese patent: Umbrella unfolding and Closing Device (Patent Number: ZL200520116792.5), an umbrella unfolding and closing way that is different from the traditional operation ways is adopted, that is, umbrella unfolding and closing are accomplished by sliding the sliding blocks with respect to a post via a knob; this device has better strength and more convenient operation than the traditional ways, but still, it requires manual operation and is more complex in structure.

SUMMARY OF THE PRESENT INVENTION

To overcome the aforementioned shortcomings, an objective of the present invention is to provide a controllable automatic umbrella unfolding device, in which a nitrogen spring and a valve opening device for the nitrogen spring are disposed in a center bar of the umbrella to realize automatic umbrella unfolding, convenient operation and simple structure, thus the problems in the prior art are solved.

The objective above is achieved by adopting the technical proposal below: a controllable automatic umbrella unfolding device comprises an upper runner, a middle runner, a lower runner and a center bar. The upper runner of the umbrella is fixed at the top end of the center bar, the middle runner and the lower runner of the umbrella are movably sleeved on the center bar, the upper runner is connected with long ribs, the long ribs are connected with short ribs, the middle runner is connected with branch ribs, the branch ribs are connected with the short ribs, the short ribs are connected with the lower runner, a gas spring is disposed in the center bar, the tail end of a cylinder barrel of the gas spring is connected with the middle runner of the umbrella, a valve is arranged at the end of a piston rod of the gas spring, a valve opening device is disposed corresponding to the valve, the valve opening device comprises a gas spring support, a U-shaped sheet metal part, a driving lever, a lever, a pin shaft and a spring, the gas spring support is fixed at a specified position of the center bar, a screw II on the U-shaped sheet metal part is sleeved inside a pair of long through holes on the gas spring support, the U-shaped sheet metal part is movably connected to the gas spring support through the screw II, the end of the piston rod of the gas spring, after the spring is sleeved thereon, passes through the U-shaped sheet metal part and is then fixed on the gas spring support through a nut, the lever is erected on the screw II and movably connected to the gas spring support through the pin shaft, and the driving lever is fixedly connected with the lever.

Preferably, the gas spring is a nitrogen spring.

Preferably, the pair of long through holes on the gas spring support is elliptical long through holes.

The present invention has the beneficial effects that: the device accomplishes stroke control by controlling the valve of the gas spring via the lever, so that the stroke can be stopped at any position; compared with the conventional devices, the device with no crank, umbrella rope and pull lever has the advantages of automatic umbrella unfolding, controllable stroke, simple structure, very few components and relatively low cost

Figure 1:
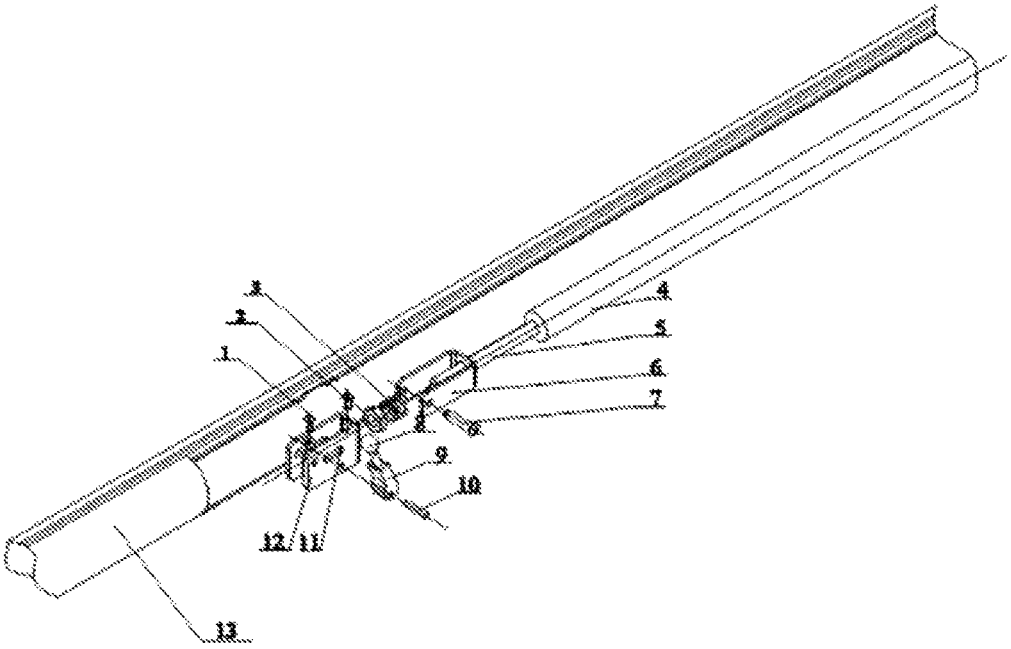
FIG. 1 is an exploded schematic view of the controllable automatic umbrella unfolding device.

In the drawings: 1-screw I, 2-nut, 3-spring, 4-cylinder barrel of nitrogen spring, 5-piston rod of nitrogen spring, 6-U-shaped sheet metal part, 7-screw II, 8-driving lever, 9-lever, 10-pin shaft, 11-long through hole, 12-gas spring support, 13-center bar, 14-valve, 15-long rib, 16-short rib, 17-branch rib, 18-upper runner, 19-middle runner, and 20-lower runner.

DETAILED DESCRIPTION OF THE EMBODIMENTS

The present invention will be further described below by the embodiments with reference to the accompanying drawings.

Figure 2:
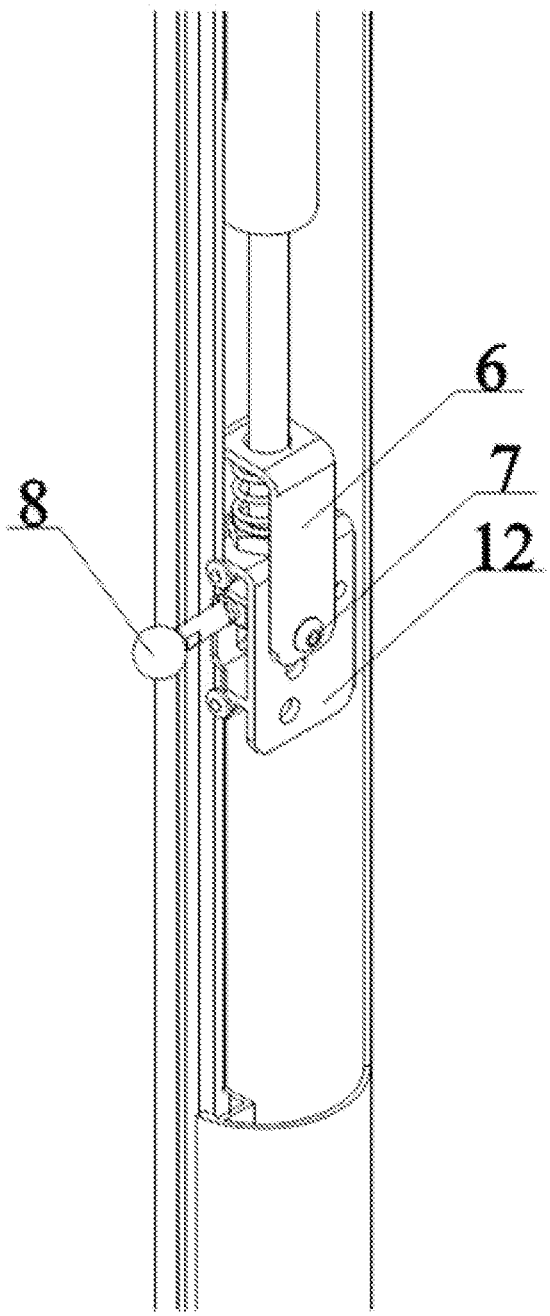
FIG. 2 is a three-dimensional view of the valve opening device.
Figure 3:
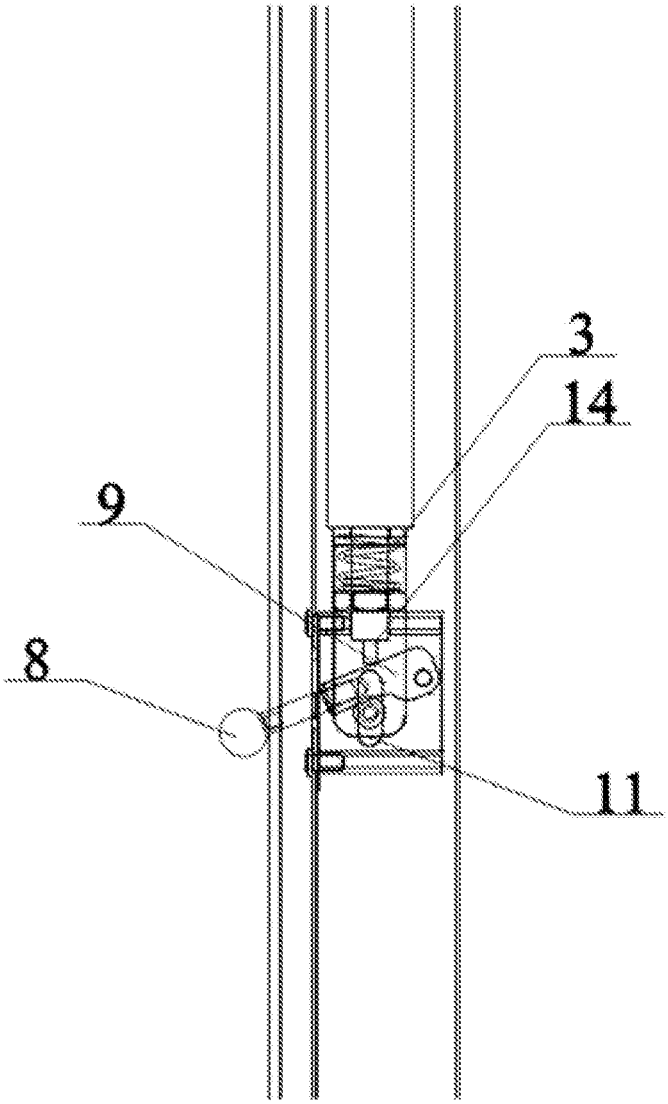
FIG. 3 is a schematic view of the valve opening device in FIG. 2 when closed.
Figure 4:
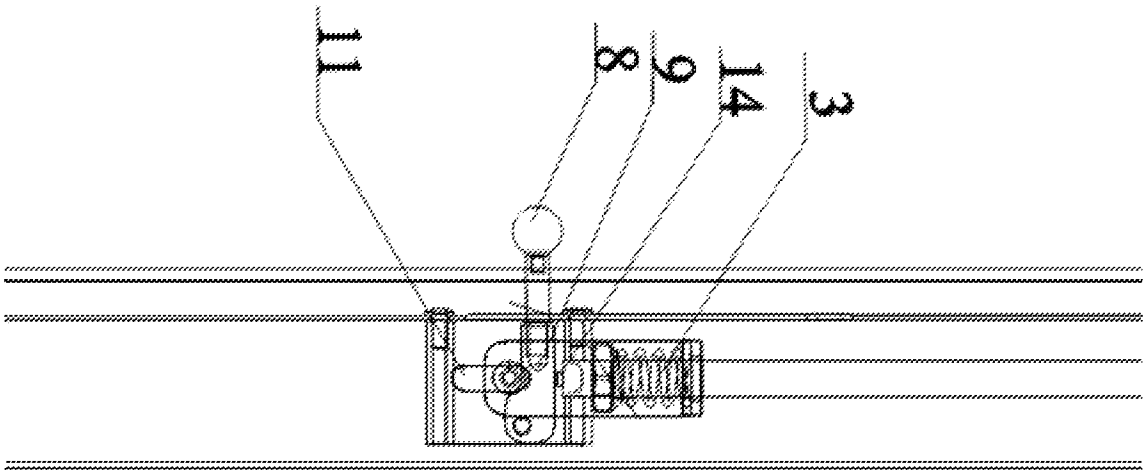
FIG. 4 is a schematic view of the valve opening device in FIG. 2 when opened.
Figure 5:
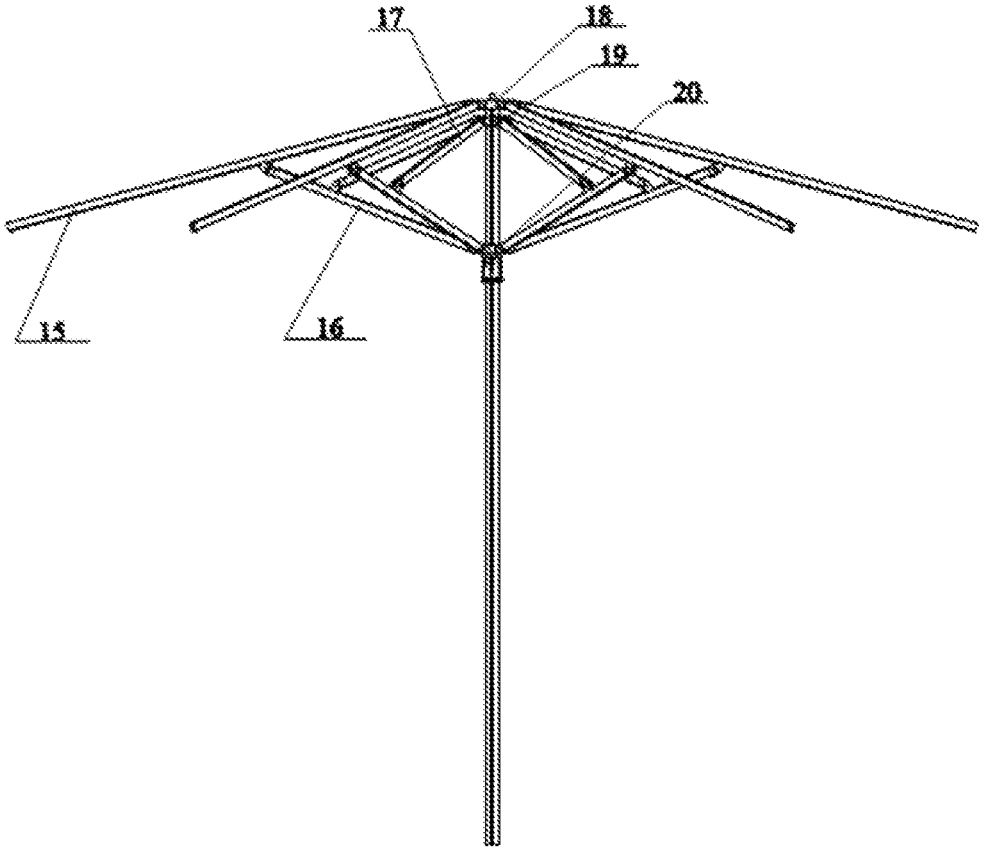
FIG. 5 is an overall three-dimensional view of the controllable automatic umbrella unfolding device.

Embodiment 1: as shown in FIG. 1, FIG. 2, FIG. 3, FIG. 4 and FIG. 5, a controllable automatic umbrella unfolding device comprises an upper runner 18, a middle runner 19, a lower runner 20 and a center bar 13. The upper runner 18 of the umbrella is fixed at the top end of the center bar 13. The middle runner 19 and the lower runner 20 of the umbrella are movably sleeved on the center bar 13. The upper runner 18 is connected with long ribs 15. The long ribs 15 are connected with short ribs 16. The middle runner 19 is connected with branch ribs 17. The branch ribs 17 are connected with the short ribs 16. The short ribs 16 are connected with the lower runner 20. A gas spring is disposed in the center bar 13. The tail end of a cylinder barrel 4 of the gas spring is connected with the middle runner 19 of the umbrella. A valve 14 is arranged at the end of a piston rod 5 of the gas spring. A valve opening device is disposed corresponding to the valve 14. The valve opening device comprises a gas spring support 12, a U-shaped sheet metal part 6, a driving lever 8, a lever 9, a pin shaft 10 and a spring 3. The gas spring support 12 is fixed at a specified position of the center bar 13 through a screw I 1, a screw II 7 on the U-shaped sheet metal part 6 is sleeved inside a pair of long through holes 11 on the nitrogen spring support 12, the U-shaped sheet metal part 6 is movably connected to the nitrogen spring support 12 through the screw II 7, the end of the piston rod 5 of the nitrogen spring, after the spring 3 is sleeved thereon, passes through the U-shaped sheet metal part 6 and is then fixed on the nitrogen spring support 12 through a nut 2, the lever 9 is erected on the screw II 7 and movably connected to the nitrogen spring support 12 through the pin shaft 10, and the driving lever 8 is fixedly connected with the lever 9.

In practical use, the valve opening device controls free positioning of the umbrella in its opening process by moving the driving lever. The controllable gas spring is featured by the fact that: stroke that is controlled by valve opening and closing can be stopped at any position.

The working principle is that: when the umbrella is about to be closed, the lower runner is gripped and moved downwards. At the same time, the cylinder barrel of the nitrogen spring is moved downwards to drive the U-shaped sheet metal part to be moved downwards against the elasticity of the spring, the screw II that is fixed on the U-shaped sheet metal part is moved downwards, the lever swings downwards around the pin shaft owing to the elasticity of the valve (the valve is stretched out because of own elasticity, and the valve is closed under the default state), the valve is stopped at the current stroke after being completely stretched out to be closed, thus positioning for umbrella closing is accomplished. When the umbrella is about to be opened, the driving lever is moved upwards to open the valve, the valve is retracted into the piston rod of the nitrogen spring, in the meantime, the cylinder barrel of the nitrogen spring is moved upwards, and umbrella unfolding is then accomplished based upon the structural relationship of the product.

The controllable gas spring functions as follows: in case of umbrella closing, the built-in gas spring is compressed at a position where the stroke is close to the limit and is under a state of compression and preparation for bounce, at this moment, the valve is closed so that the stroke is located at the position of the bottom end that is close to the limit, thereby ensuring the closing state of the umbrella. When the valve is opened by moving the driving lever, the gas spring resets to drive the middle runner to move towards the upper runner, and in accordance with the structural relationship in assembly, the middle runner is connected with the branch ribs, the branch ribs are connected with the short ribs, and then, the short ribs drive the lower runner to move towards the upper runner, until the umbrella cover is unfolded to realize umbrella unfolding.

While the embodiments of the present invention and the technical principle adopted have been described above, any modifications made in accordance with the concept of the present invention shall still fall within the scope of the present invention only if their resulting functions are not beyond the spirits covered by the description and the accompanying drawings.

The invention claimed is:

1. A controllable automatic umbrella unfolding device, comprising an upper runner, a middle runner, a lower runner and a center bar, the upper runner of the umbrella being fixed at the top end of the center bar, the middle runner and the lower runner of the umbrella being movably sleeved on the center bar, the upper runner being connected with long ribs, the long ribs being connected with short ribs, the middle runner being connected with branch ribs, the branch ribs being connected with the short ribs, the short ribs being connected with the lower runner, characterized in that a gas spring is disposed in the center bar, the tail end of a cylinder barrel of the gas spring is connected with the middle runner of the umbrella, a valve is arranged at the end of a piston rod of the gas spring, and a valve opening device is disposed corresponding to the valve, characterized in that the valve opening device comprises a gas spring support, a U-shaped sheet metal part, a driving lever, a lever, a pin shaft and a spring, the gas spring support is fixed at a specified position of the center bar, a screw on the U-shaped sheet metal part is sleeved inside a pair of long through holes on the gas spring support, the U-shaped sheet metal part is movably connected to the gas spring support through the screw, the end of the piston rod of the gas spring, after the spring is sleeved thereon, passes through the U-shaped sheet metal part and is then fixed on the gas spring support through a nut, the lever is erected on the screw and movably connected to the gas spring support through the pin shaft, and the driving lever is fixedly connected with the lever.

2. The controllable automatic umbrella unfolding device according to claim 1, characterized in that the gas spring is a nitrogen spring.

3. The controllable automatic umbrella unfolding device according to claim 1, characterized in that the pair of long through holes on the gas spring support is elliptical long through holes.

* * * * *